US007362051B2

(12) United States Patent
Kweon

(10) Patent No.: US 7,362,051 B2
(45) Date of Patent: Apr. 22, 2008

(54) PLASMA DISPLAY PANEL AND METHOD OF MANUFACTURING THE SAME RESULTING IN IMPROVED CONTRAST AND IMPROVED CHROMATICITY

(75) Inventor: Tae-Joung Kweon, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 512 days.

(21) Appl. No.: 10/932,260

(22) Filed: Sep. 2, 2004

(65) Prior Publication Data

US 2005/0052138 A1 Mar. 10, 2005

(30) Foreign Application Priority Data

Sep. 8, 2003 (KR) ..... 10-2003-0062549

(51) Int. Cl.
*H01J 17/49* (2006.01)

(52) U.S. Cl. ..... 313/586; 313/582

(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 2001/0048275 | A1* | 12/2001 | Nakada et al. ..... 315/160 |

(Continued)

FOREIGN PATENT DOCUMENTS

| | | |
|---|---|---|
| JP | 02-148645 | 6/1990 |

(Continued)

OTHER PUBLICATIONS

Office Action from the Korean Intellectual Property Office issued in Applicant's corresponding Korean Patent Application No. 10-2003-0062549 dated Jul. 25, 2005.

(Continued)

*Primary Examiner*—Joseph Williams
*Assistant Examiner*—Bumsuk Won
(74) *Attorney, Agent, or Firm*—Robert E. Bushnell, Esq.

(57) ABSTRACT

A plasma display panel structure and a method of manufacturing the same. The plasma display panel has a front portion having a substrate having sustain electrodes. The plasma display panel has a front dielectric layer that attaches to the front portion. The front dielectric layer has colored dielectric layers made of a different material for each discharging spaces of red, green, and blue color and, colored dielectric layers being disposed corresponding to discharging spaces of red, green, and blue colors. Lattice dielectric layers are also formed to improve contrast. The colored and the lattice dielectric layers being fine pitch or high density patterned formed by a compression tool. The plasma display panel also has a rear substrate on which address electrodes are formed in a direction orthogonal to the sustain electrodes.

19 Claims, 7 Drawing Sheets

U.S. PATENT DOCUMENTS

2003/0201428 A1* 10/2003 Fukushima et al. ..... 252/570

FOREIGN PATENT DOCUMENTS

| | | |
|---|---|---|
| JP | 10-116562 | 5/1998 |
| JP | 2845183 | 10/1998 |
| JP | 2917279 | 4/1999 |
| JP | 2001-325888 | 11/2001 |
| JP | 2001-043804 | 12/2001 |
| JP | 2003-031134 | 1/2003 |
| KR | 1998-080763 | 11/1998 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

CIE Chromaticity Diagram

PLASMA DISPLAY PANEL AND METHOD OF MANUFACTURING THE SAME RESULTING IN IMPROVED CONTRAST AND IMPROVED CHROMATICITY

CLAIM OF PRIORITY

This application makes reference to, incorporates the same herein, and claims all benefits accruing under 35 U.S.C. §119 from an application for PLASMA DISPLAY PANEL AND METHOD OF MANUFACTURING THE SAME earlier filed in the Korean Intellectual Property Office on 8 Sep. 2003 and there duly assigned Serial No. 2003-62549.

BACKGROUND OF THE INVENTION

1. Field of the Invention

The present invention relates to a plasma display panel and a method of manufacturing the same, and more particularly, to a plasma display panel having improved chromaticity and improved contrast, the improved contrast brought about by reducing an external reflectance, and a method of manufacturing the same.

2. Description of the Related Art

A plasma display panel generates images by exciting phosphor layers formed in a predetermined pattern in a closed space filled with a discharge gas. The phosphor layers are excited by ultraviolet light generated by glow discharge between two electrodes receiving a predetermined voltage.

According to a driving method, the plasma display panel (PDP) can be classified into three types, a direct current type, an alternate current type, and a mixed type. According to the electrodes, a plasma display panels (PDP) can be classified two types, a two-electrode PDP where two electrodes is the minimum number of electrodes for discharging, and a three-electrode PDP. The direct current type PDP has an auxiliary electrode for inducing an auxiliary discharge, and the alternate current type PDP has address electrodes for improving an address speed by distinguishing a addressing discharge form a sustaining discharge.

Also, according to the disposition of electrode structure for discharging, the alternate current type PDP can further be classified into two types, a facing type electrode structure and a surface discharge type electrode structure. In the case of the facing type electrode structure, one sustain electrode for generating a discharge is disposed on the front substrate and the other sustain electrode is disposed on the rear substrate, and the discharge occurs in a vertical direction in the panel. In the case of the surface discharge type electrode structure, two electrodes are disposed on a substrate, and the discharge occurs on the same plane on the substrate.

A discharge gas is filled in the plasma display panel. Generally, the discharge gas is a column eight inert noble gas such as He, Xe, Ne, etc. When Ne is used as a discharge gas, Ne prevents accelerated gas ions from colliding and damaging a dielectric layer or a phosphor layer. However, because the Ne gas generates a visible orange color and thus reduces the chromaticity during discharging, a corresponding color filter layer can be formed in the discharging space to solve this problem.

Other matters to be considered are the problems of reflection brightness and contrast of the panel based on the intensity of the reflected external light. In order to minimize these problems, a design that reduces the intensity of external light that is reflected can be built into the display. Such a design could include a black stripe disposed between the bus electrodes in non-discharge regions that serves to reduce the intensity of the reflected light thereby improving image contrast.

A plasma display panel using a color filter layer and a black stripe is disclosed in Japanese Laid-Open Publication No. 1998-116562, and Japanese Patent Laid-Open publication No. 2003-31134. In such displays, the color filter layer and the black stripe are formed by a screen printing method or a photosensitive paste method by a photo etching process. The screen printing method has a drawback in that it can not be applied to a fine pitch (or high definition) plasma display panel. Also the photosensitive paste method requires expensive equipment and a very complicated process, thereby increasing manufacturing cost.

SUMMARY OF THE INVENTION

It is therefore an object of the present invention to provide an improved design for a plasma display panel.

It is also an object of the present invention to provide a method for making the novel and improved plasma display panel.

It is further an object of the present invention to present a design for a plasma display panel that has improved chromaticity and improved contrast while being a fine pitch (or high definition), high density plasma display.

It is further an object of the present invention to provide a method for making the plasma display panel where manufacturing costs are minimized while producing a display with improved chromaticity and improved image contrast with fine pitch and high density.

These and other objects can be achieved by a plasma display panel having a front dielectric layer sandwiched between a rear substrate and a front substrate, the front dielectric layer having a lattice dielectric layer and colored dielectric layer on a dielectric film. The front substrate has sustain electrodes disposed a predetermined distance apart from each other, the front dielectric layer that covers the sustain electrodes. The colored dielectric layers are made of a different material for each discharging spaces of red, green, and blue color. The colored dielectric layers are disposed corresponding to discharging spaces of red, green, and blue color respectively. Lattice dielectric layers are also employed to improve contrast. The display is fine pitch or high definition with the width of the colored dielectric layers being about 130 to 160 microns and the width of the lattice dielectric layers being 50 to 70 microns. The display further includes a rear substrate on which address electrodes are formed in a direction to orthogonal to the sustain electrodes, the address electrodes formed on a side of the rear substrate that faces the front substrate. The rear substrate has a rear dielectric layer that cover the address electrodes. Partition walls are formed on the rear dielectric layer. The partition walls include phosphor layers. The partition walls define discharging spaces of red, green, and blue colors between the front substrate and the rear substrate.

The present invention also provides a method of manufacturing the above plasma display panel. The method includes preparing a dielectric film and a compression tool on which a predetermined pressing part is formed on a surface facing the dielectric film, forming colored dielectric grooves and lattice dielectric grooves corresponding to the discharging spaces by pressing and separating the compression tool and the dielectric film. Then, lattice dielectric material and colored dielectric material is filled in the lattice dielectric grooves and the colored dielectric grooves respectively forming the lattice dielectric layers and the colored dielectric layers respectively. Then, the completed front dielectric layer with the dielectric film, the lattice dielectric layers and the colored dielectric layers are laminated or attached to the front substrate to cover the sustain electrodes formed on the front substrate. Colored dielectric layers improve the chromaticity of the display and the lattice dielectric layers improve the contrast of the display.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
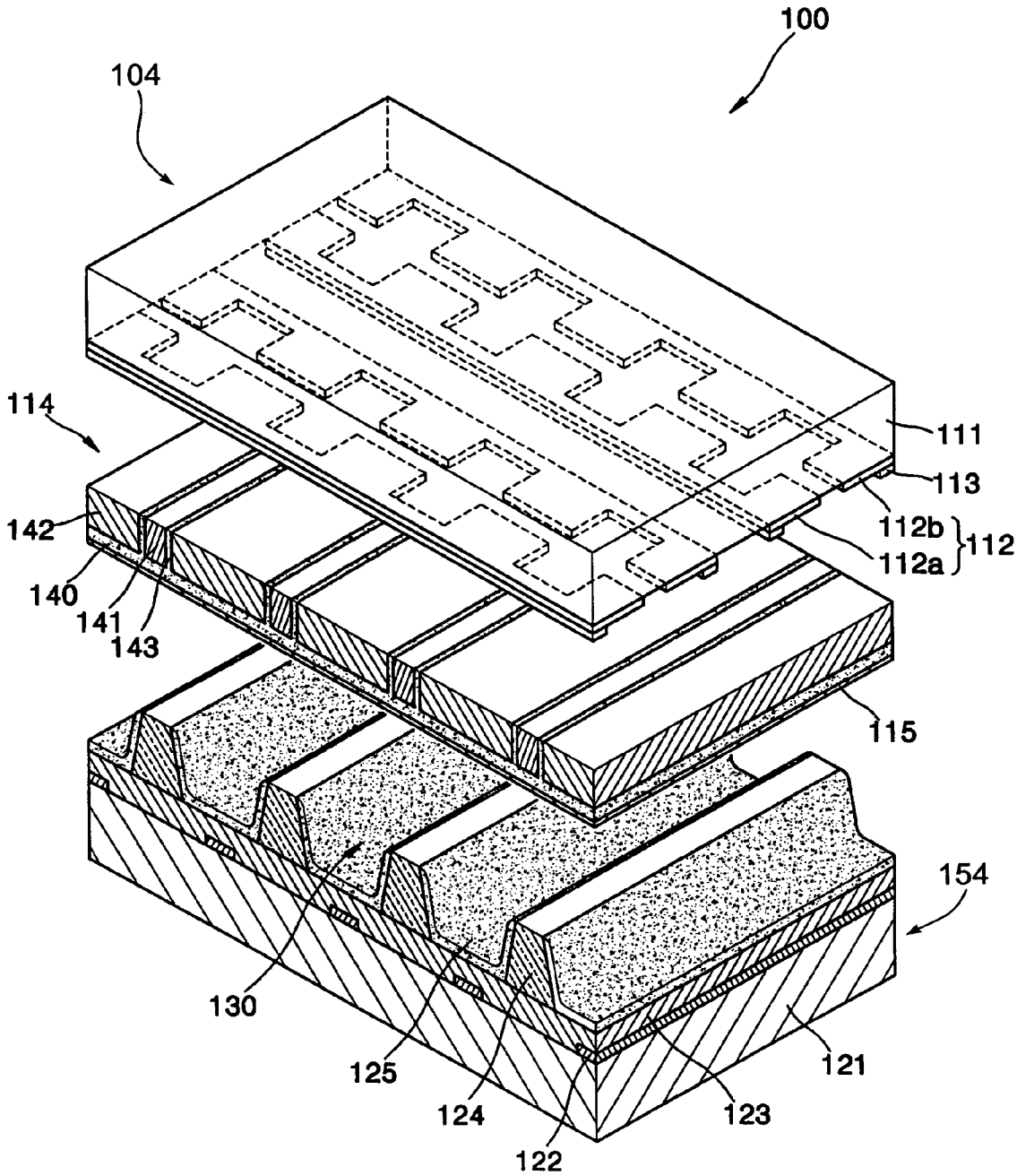
FIG. 1 is an exploded perspective view of a plasma display panel according to a first embodiment of the present invention.
Figure 2:
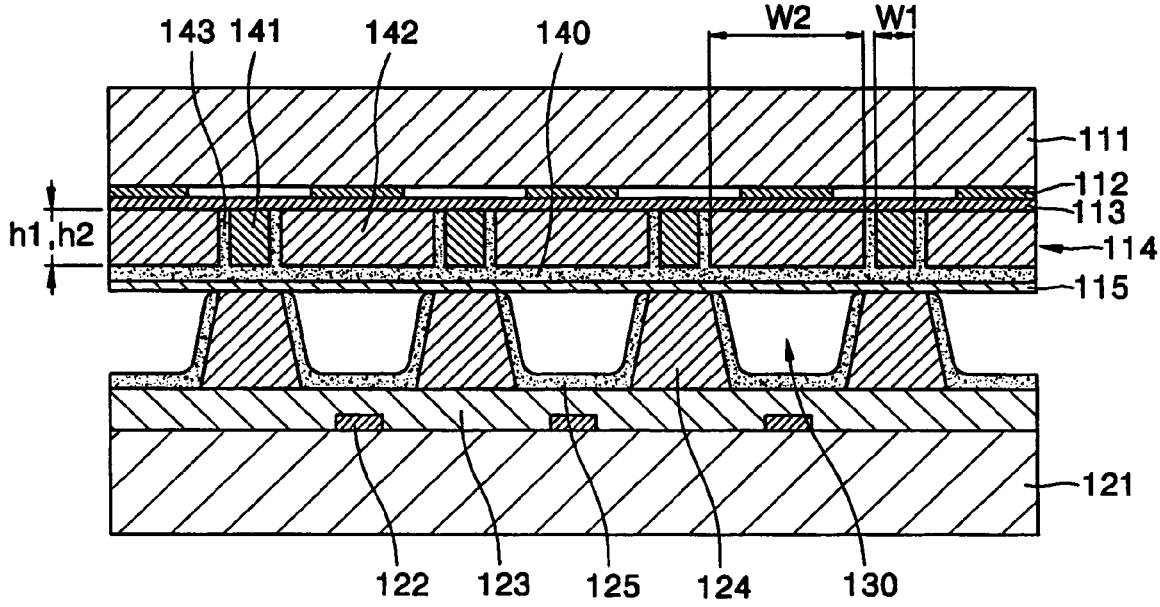
FIG. 2 is a partial cross-sectional view of the plasma display panel in FIG. 1.

Turning now to the figures, FIGS. 1 and 2 illustrate a plasma display panel 100 according to a first embodiment of the present invention. Referring to FIGS. 1 and 2, the plasma display panel 100 has a front portion 104, a rear portion 154 and a front dielectric layer 114 sandwiched between the front portion 104 and the rear portion 154. Front portion 104 is primarily made out of front substrate 111 which is made out of glass or some other transparent material. Front portion 104 also includes sustain electrodes 112 and bus electrodes 113 that are formed on a lower surface of the front substrate 111. As illustrated in FIG. 1, each sustain electrode 112 has notched or narrow portions that correspond to where partition wall 124 of rear portion 154 attaches to. However, the sustain electrodes 112 can instead be formed to have a uniform width, but the structure of the sustain electrodes 112 is not limited thereto. The sustain electrodes 112 can be formed of an optically transparent conductive material such as an ITO film on a lower surface of the front substrate 111. The sustain electrodes 112 can be divided into common electrodes 112*a* and scan electrodes 112*b*. The common electrodes 112*a* and the scan electrodes 112*b* are disposed alternately and are separated from each other by a predetermined gap for discharging there between.

Front portion 104 also includes bus electrodes 113 which are parallel to the sustain electrodes 112 and have a narrower width than that of the sustain electrodes 112 for reducing a line resistance. Bus electrodes 113 are formed on each lower surface of the sustain electrodes 112. Here, the bus electrodes 113 can be formed of a metal having a high conductivity, such as a material containing Ag paste as the main component. It is also within the scope of the present invention to omit the bus electrodes.

The sustain electrodes 112 and the bus electrodes 113 are covered by a front dielectric layer 114 according to the present invention. The front dielectric layer 114 has a dielectric film 140 on which lattice dielectric layers 141 and colored dielectric layers 142 are formed. A separation wall 143 may separate the colored dielectric layers 142 from the lattice dielectric layers 141. A protective layer 115 such as an MgO layer is further formed on a lower surface of dielectric film 140 on a surface opposite to that of lattice dielectric layers 141 and colored dielectric layers 142. Further details of the front dielectric layer 114 will be described later.

Rear portion 154 is formed on an opposite side of front dielectric layer 114 than front portion 104. Rear portion 154 is made up of a rear substrate 121 having a plurality of address electrodes 122 formed on the rear substrate 121. The address electrodes 122 are formed parallel to each other in stripes. These address electrodes 122 are orthogonal to the bus electrodes 113. The address electrodes 122 are spaced apart from each other by a predetermined distance, but the configuration of the address electrodes 122 is not limited thereto. On top of the rear substrate 121 containing the patterned address electrodes 122 is a rear dielectric layer 123. Rear dielectric layer 123 is formed on a side of the rear substrate 121 that faces the front dielectric layer 114 and front portion 104.

Partition walls 124 are formed on top of the rear dielectric layer 123. Partition walls 124 are formed in a striped pattern and each stripe is spaced apart a predetermined distance from each other. The partition walls 124 define discharging spaces 130 between the front substrate 111 and the rear substrate 121. The partition walls 124 have a predetermined height and width, and are formed in parallel to the address electrodes 122. Each stripe of address electrode 122 is formed between two adjacent stripes of partition walls 124 and vice versa. In each discharging space 130, the common electrode 112*a* and the scan electrode 112*b* of the sustain electrode 112 make a pair and are arranged so that they are disposed from address electrodes 122 to form a predetermined discharge gap between the sustain electrode 112 and the address electrode 122.

The configuration of partition walls 124 is in no way limited to the configuration illustrated in FIG. 1. Any configuration of the partition walls that can define the discharging space by arranging a pattern of pixel can be used. A phosphor layer 125 is formed in each discharging space 130. Each discharge space 130 is divided from each other by the partition walls 124. The phosphor layer 125 can be sub-divided into a red phosphor layer, a green phosphor layer, and a blue phosphor layer according to the color of the phosphor, and accordingly, the discharging space 130 also can be divided into a red color discharging space, a green color discharging space, and a blue color discharging space. The three discharging spaces are disposed close to each other to group the three colors.

The front dielectric layer 114 is disposed on an upper part of the discharging spaces 130 on top of the partition walls 124, according to the present invention. The front dielectric layer 114 can be formed of the dielectric film 140, such as a dry film resist (DFR) film as the main body. The lattice dielectric layers 141 with a predetermined pattern and the colored dielectric layers 142 are formed as one body in the dielectric film 140 in front dielectric layer 114.

The lattice dielectric layers 141 serve as a blocking film for preventing external light from reflecting off the display 100. Colored dielectric layers 142 serves as a color filter for improving chromaticity. The lattice dielectric layers 141 can be made out of PbO, $B_2O_3$, $SiO_2$, $Al_2O_3$ or ZnO. In addition, FeO, $RuO_2$, TiO, $Ti_3O_5$, $Ni_2O_3$, $CrO_2$, $MnO_2$, $Mn_2O_3$, $Mo_2O_3$, or $Fe_3O_4$ can be selectively mixed into the lattice dielectric layers 141.

Each of the lattice dielectric layers 141 on front dielectric layer 114 is patterned to correspond to the stripes of each partition wall 124 on rear portion 154. Each of the lattice dielectric layers 141 is formed on dielectric film 140. Lattice dielectric layers 141 are formed to have a predetermined width w1 and a predetermined height h1.

The width w1 of the lattice dielectric layers 141 may vary according to a width of an upper surface of the partition walls 124, and preferably width w1 is approximately 50~70 μm. Also, the height h1 of the lattice dielectric layers 141 is lower than a thickness of the dielectric film 140, and it is preferable that the height h1 of the dielectric layers 141 is 20~70 μm when the thickness of the dielectric film 140 is 80 μm. In the above thickness for dielectric film 140, the thickness of 80 μm includes the thickness of the separation walls 143. Thus, the thickness of the dielectric film 140 in FIGS. 1 and 2 is actually made up of the thickness of the portion labeled 140 plus the thickness of the portion labeled 143. This total thickness is greater than the thickness of 20~70 μm for the lattice dielectric layer 141.

The colored dielectric layers 142 are patterned between adjacent stripes of the lattice dielectric layers 141. Accordingly, the colored dielectric layers 142 are disposed in the discharging spaces 130. The colored dielectric layers 142 are formed to have a predetermined height h2 from a surface of the dielectric film 140. Preferably, the height h2 of the colored dielectric layers 142 is equal to the height h1 of the lattice dielectric layers 141, but this invention is in no way limited thereto. It is preferable that the width w2 of the colored dielectric layers 142 is 130~160 μm.

The colored dielectric layers 142 can be formed of a dielectric material mixed with another material. This other material may be either $Fe_2O_3$, $Cu_2O$, CuO, $Ce_2O_3$, $Co_2O_3$, CoO or $Nd_2O_3$. Preferably, the colored dielectric layers 142 for each color of discharge space are formed of the same material that can generate optimum colors of red, green, and blue. The colored dielectric layers 142 can also be formed of different materials for each of the different color discharge spaces to improve the chromaticity of red, green, and blue. For example, a dielectric material for the colored dielectric layers 142 corresponding to the red color, green color, and blue color discharging spaces respectively can contain one of $Fe_2O_3$ and $Cu_2O$ for the red discharge space, one of CuO and $Ce_2O_3$ for the green discharge space, and one of $Co_2O_3$, CoO, and $Nd_2O_3$ for the blue discharge space.

It is preferable to have a separation wall 143 formed of the same material as the dielectric film 140. Separation wall 143 serves to separate the lattice dielectric layers 141 from the colored dielectric layers 142. The separation wall 143 helps the formation of pattern of the lattice dielectric layers 141 and the colored dielectric layers 142 on the dielectric film 140. Separation wall 143 also serves to block the mixing of the dielectric material of the lattice dielectric layers 141 and the dielectric material of the colored dielectric layers 142. A width of the separation walls 143 is preferably determined within a range not to affect the function of the lattice dielectric layers 141 and the colored dielectric layers 142. However, the width of the separation walls 143 is not limited thereto. Also, it is possible to form front dielectric layer 114 without any separation walls 143.

Each of the lattice dielectric layers 141 and the colored dielectric layers 142 are formed on a surface of the dielectric film 140. The sides of dielectric film 140 covered with the lattice dielectric layers 141 and the colored dielectric layers 142 is laminated to the front substrate 111 of front portion 104 after forming the lattice dielectric layers 141 and the colored dielectric layers 142 on dielectric film 140. The efficiency of blocking reflected external light can be increased by disposing the lattice dielectric layers 141 and the colored dielectric layers 142 closer to the front substrate 111 than to the discharging spaces 130.

Turning now to FIGS. 3A through 3F, FIGS. 3A through 3F are cross-sectional views for describing a process for making display 100 according to the present invention. FIGS. 3A through 3D illustrate the process for forming front dielectric layer 114.

Figure 3A:
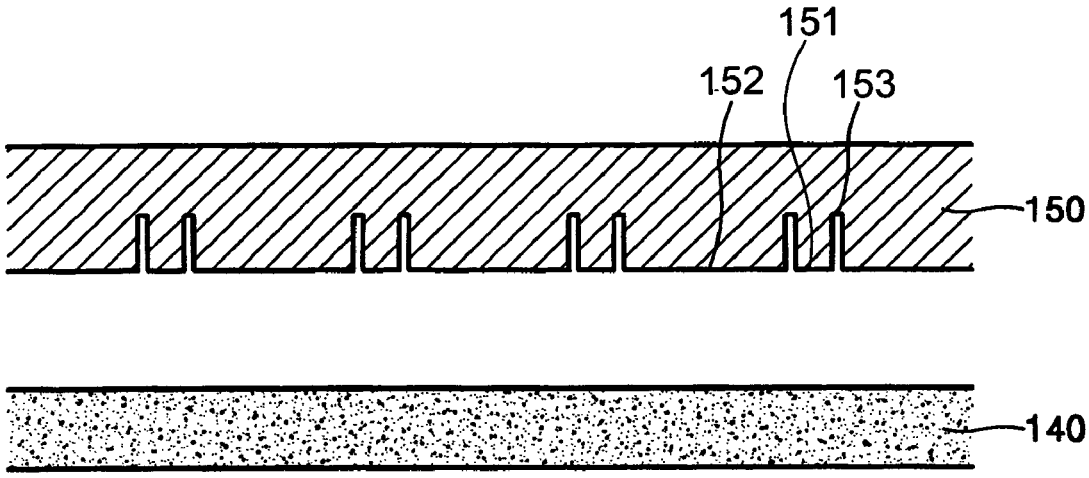
FIGS. 3A through 3F are cross-sectional views for describing process for forming the front dielectric layer and for forming the plasma display panel of the first embodiment of the present invention.

Referring to FIG. 3A, a dielectric film 140 having a predetermined thickness and a compression tool 150 facing the dielectric film 140 are prepared. Pressing parts 151 and 152 with a predetermined pattern and groove part 153 formed between the pressing parts 151 and 152 are formed on a surface of the compression tool 150.

Figure 3B:
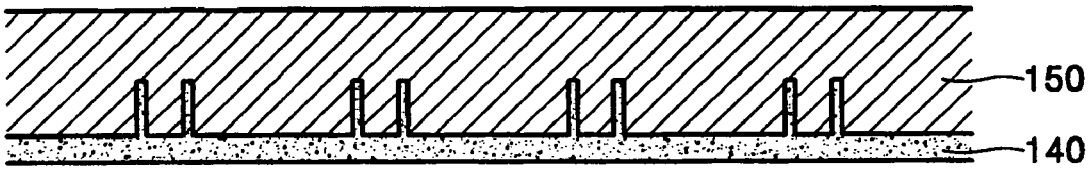

Referring to FIG. 3B, the compression tool 150 with the pressing parts 151 and 152 and the groove parts 153 is pressed on the dielectric film 140. Then, the dielectric film 140 is compressed and a portion of the dielectric film enters into the grooves of the groove parts 153 of compression tool 150.

Figure 3C:
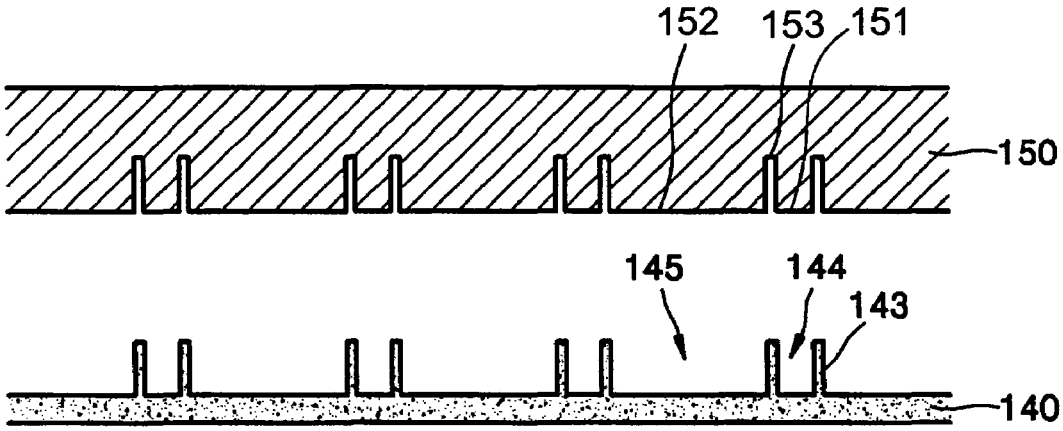

Referring to FIG. 3C, when the compression tool 150 is separated from the dielectric film 140, lattice dielectric grooves 144 and colored dielectric grooves 145 are formed on the dielectric film 140 with separation walls 143 formed there between. Separation walls 143 are preferably made out of the same material as dielectric film 140. The size and location of the lattice dielectric grooves 144 and the colored dielectric grooves 145 correspond to the size and location of the pressing parts 151 and 152 respectively of the compression tool 150. Also, the locations of the separation walls 143 on dielectric film 140 correspond to the location of the groove parts 153 on the compression tool 150.

Figure 3D:
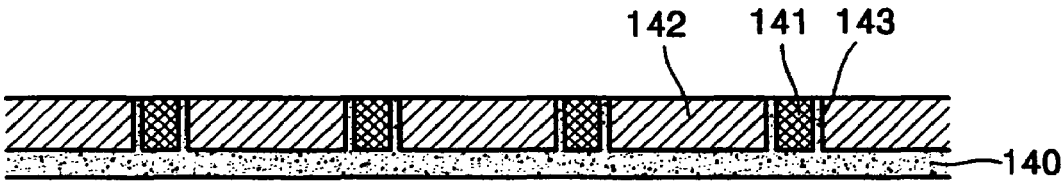

Referring to FIG. 3D, a lattice dielectric material is filled in the lattice dielectric grooves 144 to form lattice dielectric layers 141. A colored dielectric material is filled in the colored dielectric grooves 145 to form colored dielectric layers 142, resulting in a front dielectric layer 114. The separation walls 143 are disposed in the boundaries between the lattice dielectric layers 141 and the colored dielectric layers 142. Minus protective layer 115, this essentially completes the formation of front dielectric layer 114.

Figure 3E:
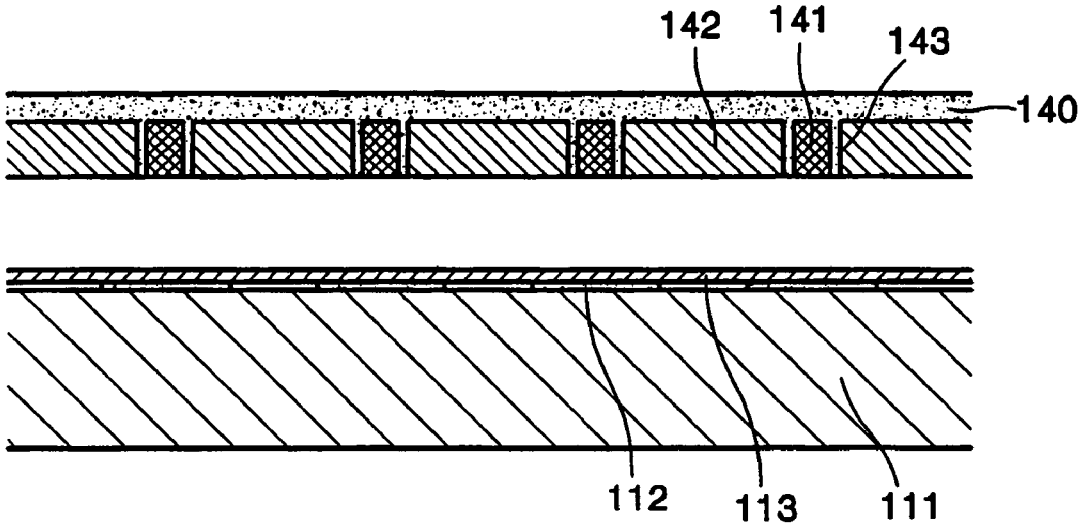

Next, referring to FIG. 3E, FIG. 3E illustrates the formation of front portion 104. First, the sustain electrodes 112 are formed and patterned on a surface of the front substrate 111. Then, the bus electrodes 113 are formed on the sustain electrodes 112 on front substrate 111.

Figure 3F:
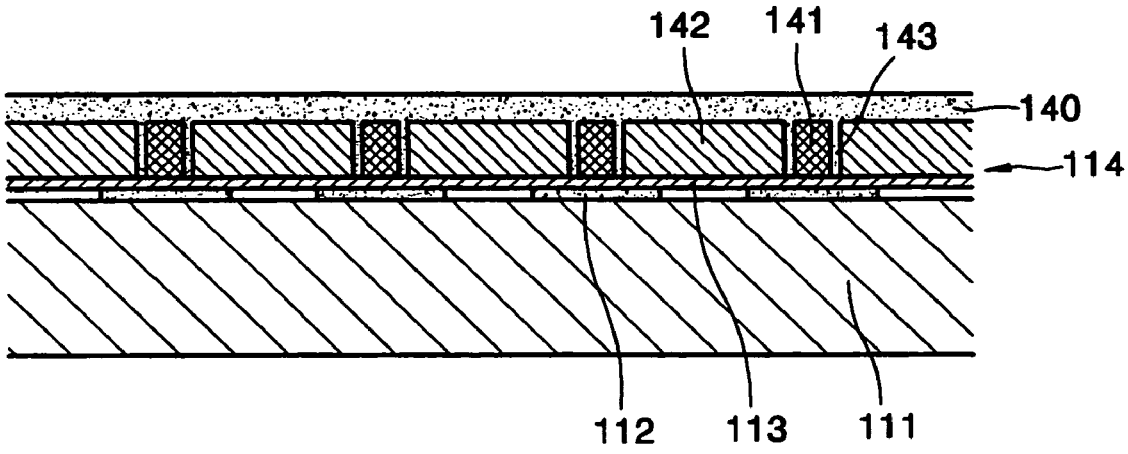

Referring now to FIG. 3F, the completed front dielectric layer 114 is laminated on the electrode side of the front portion 104. At this time, the side of the front dielectric layer 114 that has the lattice dielectric layers 141 and the colored dielectric layers 142 is laminated or attached to the side of front portion 104 containing the sustain electrodes 112 and the bus electrodes 113.

In an alternate embodiment, the formation of front portion 104 contains an additional step to cover the sustain electrodes 112 and the bus electrodes 113. When sustain electrodes 112 and/or bus electrodes 113 have a large thickness and thus protrude a great distance from the front substrate 111, these electrodes can damage and deform the dielectric layer 114 when laminated thereto. Therefore, when these electrodes are very thick and have a large height, it is preferable to apply an additional dielectric layer to a bottom of front portion 104 to bury the sustain electrodes 112 and the bus electrodes 113 with before laminating the front part 104 to the front dielectric layer 114. However, if the thickness of the electrodes is small, this additional dielectric layer can be omitted.

Referring to Table 1 below, Table 1 illustrates the empirical results of reflection brightness and chromaticity characteristics of the novel plasma display panel 100 of FIGS. 1 and 2 compared with another comparison plasma display panel. The novel plasma display panel in Table 1 has the respective height of the lattice dielectric layer 141 and colored dielectric layer 142 (h1 and h2 respectively) both of 20 μm, the width of the lattice dielectric layer 141 (w1) is 60 μm, and the width of the colored dielectric layer 142 (w2) is 150 μm. The comparison plasma display of Table 1 does not have either a lattice dielectric layer nor a colored dielectric layer. The reflected intensity of external light is listed in Table 1 is in terms of cd/m2 where cd is candela or candles. The smaller this reflected intensity is, the better the contrast ratio of the display and the better the quality of the image for the display. Also listed in Table 1 are the chromaticity coordinates for the red, blue and green colors for a 1931 CIE (x,y) chromaticity diagram, where CIE stands for Comité International de l'Eclairage. Chromaticity coordinates R1, G1, and B1 are the red, green and blue chromaticity coordinates of the plasma display device 100 of the present invention while the chromaticity coordinates R2, G2 and B2 are the chromaticity coordinates for the comparison plasma display device absent the lattice and colored dielectric layers. It is also noted that the chromaticity coordinates for both displays are plotted on a 1931 CIE (x,y) chromaticity diagram in FIG. 4. Also listed in Table 1 is the area of the triangle defined by the three chromaticity coordinates for each display. The area of the triangle (or color reproducing area) is an indication of the amount of colors that can be displayed by the display. Thus, the larger the area of the triangle, the better the display as more colors can be displayed by such a display.

TABLE 1

| | Display according to the first embodiment of the Present Invention | Comparison display |
|---|---|---|
| Height of Lattice (h1) & Colored Layer (h2) (h1 = h2) | 20 μm | — |
| Width of the Colored Layer (w2) | 150 μm | — |
| Width of the Lattice Layer (W1) | 60 μm | — |
| Chromaticity of Red color | X = 0.663<br>Y = 0.332 (R1) | X = 0.656<br>Y = 0.333 (R2) |
| Chromaticity of Green color | X = 0.225<br>Y = 0.688 (G1) | X = 0.273<br>Y = 0.668 (G2) |
| Chromaticity of Blue color | X = 0.152<br>Y = 0.071 (B1) | X = 0.158<br>Y = 0.074 (B2) |
| Color Reproducing Area | 0.148 | 0.133 |
| Brightness by external light reflection (cd/m$^2$) | 8.54 | 14.80 |

Figure 4:
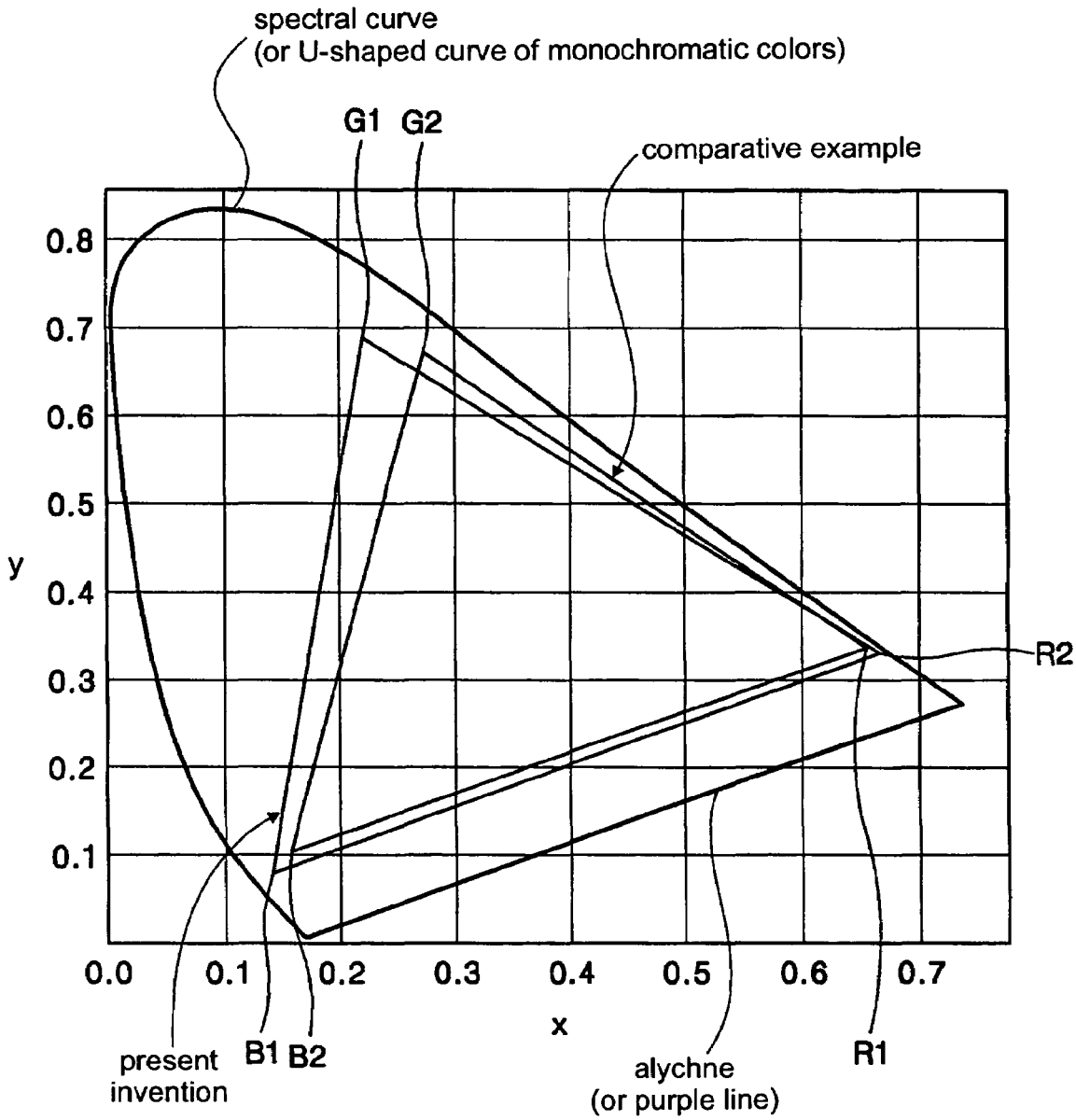
FIG. 4 is a chromaticity diagram in 1931 CIE (x,y) format illustrating empirically the chromaticity of the plasma display of the first embodiment of the present invention compared to a comparison plasma display.

Referring to FIG. 4 and Table 1, it is seen that the color reproducing area (i.e., the area inside the triangle of the chromaticity coordinates R1, G1 and B1 of FIG. 4) for the plasma display device 100 of the present invention is 0.148. In comparison, the color reproducing area of the comparison plasma display panel, which is the area inside the triangle defined by the chromaticity coordinates R2, G2 and B2 of FIG. 4 is 0.133. Because the color reproducing area of the plasma display according to the present invention is larger (in this case, 11% larger) than that of the comparison display, the plasma display of the present invention has better empirical chromaticity characteristics than the comparison plasma display. This is because the plasma display of the present invention can display more colors than the comparison display that is absent the lattice and the colored dielectric layers.

Also evident from the empirical data of Table 1 is the lower intensity of reflectance of external light off the front of the plasma display panel 100 for the plasma display panel 100 of the present invention compared to the comparison plasma display that is absent of the lattice and the colored dielectric layers. As illustrated in Table 1, the brightness value of the external light reflection according to the present invention is 8.54 cd/m$^2$, and that of the comparison display is 14.80 cd/m$^2$. Thus, the plasma display of the present invention has the intensity of reflected external light reduced by 43% compared to the intensity of the reflected external light for the comparison plasma display. This result results in better contrast in the plasma display panel 100 of the present invention compared to the comparison plasma display. This in turn results in a better image quality for the display of the present invention compared to the comparison plasma display. Therefore, by including lattice and colored dielectric layers in the front dielectric layer of the plasma display, the image quality is improved. This result has been demonstrated empirically by better chromaticity characteristics and by lower intensity of external reflected light.

Figure 5:
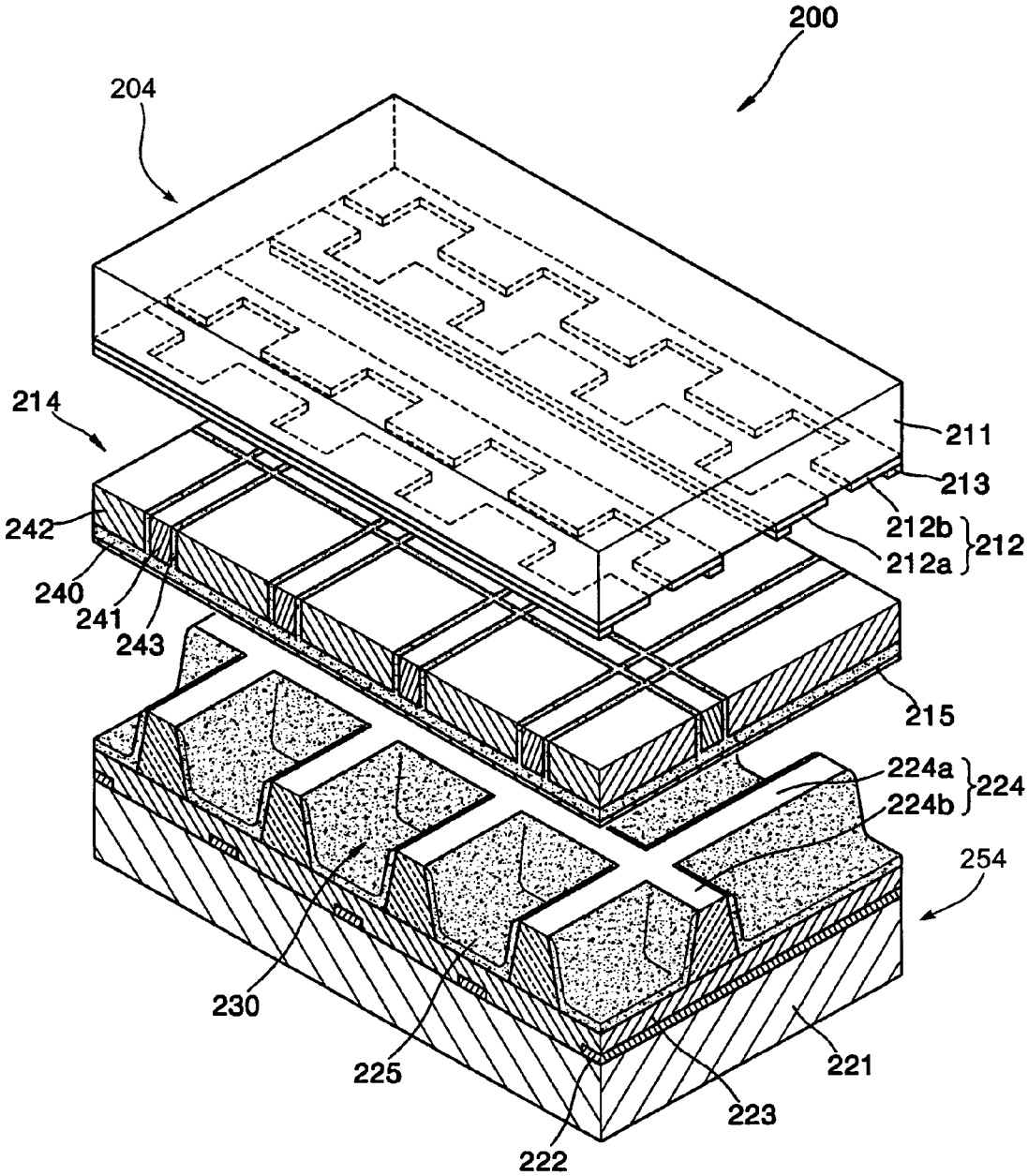
FIG. 5 is an exploded perspective view of a plasma display panel according to a second embodiment of the present invention.

Turning now to FIG. 5, FIG. 5 illustrates a plasma display panel according to a second embodiment of the present invention. Referring to FIG. 5, the plasma display panel 200 is made up of a front portion 204 as in the previous embodiment having a front substrate 211 formed of glass or a transparent material, and a rear portion 254 facing the front portion 204. Sandwiched in between the front portion 204 and the rear portion 254 is the novel front dielectric layer 214.

Sustain electrodes 212 are formed on a lower surface of the front substrate 211 of front portion 204, and bus electrodes 213 having a stripe with a narrower width than the sustain electrodes 212 are disposed on a lower surface of the sustain electrodes 212. Here, the sustain electrodes 212 can be formed of an ITO film, and the bus electrodes 213 can be formed of a conductive material.

Each sustain electrode 212 connecting to each bus electrode 213 has an incised or indented portion formed by cutting out a portion corresponding to where first partition wall 224*a* of a partition wall 224 is located after assembly of the display 200. Although an indented sustain electrode 212 is illustrated in FIG. 5, in no way is the present invention limited thereto. For example, the sustain electrodes 212 can be formed instead to have a uniform width.

The sustain electrodes 212 can be divided into common electrodes 212*a* and scan electrodes 212*b*. One of the common electrodes 212*a* and one of the scan electrodes 212*b* make a pair, and they are disposed with a predetermined gap for discharging there between.

The sustain electrodes 212 and the bus electrodes 213 are covered by a front dielectric layer 214 according to this second embodiment of the present invention. The front dielectric layer 214, as in the previous embodiment, is made out of a dielectric film 240 on which lattice dielectric layers 241 and colored dielectric layers 242 are formed. A protective layer 215 is further formed on a lower surface of the front dielectric layer 214, preferably on a side of a side of dielectric film 240 that is opposite to that of the lattice dielectric film 241 and the colored dielectric film 242. Further details about the front dielectric layer 214 will be described later.

On rear portion 254, address electrodes 222 are formed on a side of the rear substrate 221 that faces the front portion 204. The address electrodes 222 are covered by a rear dielectric layer 223. The address electrodes 222 are formed in a plurality of stripes that are preferably orthogonal to the sustain electrodes 212 and orthogonal to the bus electrodes 213 of front portion 204. Adjacent stripes of address electrodes 222 are preferably spaced apart from each other by a predetermined distance, but the present invention is in no way so limited.

Partition walls 224 with a matrix form (or grid-like structure) are formed on the rear dielectric layer 223 on rear portion 254. The partition walls 224 define discharging spaces 230 between the front substrate 211 and the rear substrate 221.

In this second embodiment, the partition walls 224 include first partition walls 224*a* spaced apart a predetermined distance from each other, and second partition walls 224*b* formed orthogonal to the first partition walls 224*a* to form the matrix form or grid-like partition walls 224 in accordance with the second embodiment of the present invention. Here, the first partition walls 224*a* are disposed parallel to address electrodes 222. Each stripe of the address electrodes 222 is preferably located between two adjacent stripes of the first partition walls 223*a*. Conversely, each stripe of the first partition walls 223*a* is preferably located between two adjacent stripes of the address electrodes 222.

The second partition walls 224*b* can be formed of the same material as the first partition walls 224*a*, and the second partition walls 224*b* can be formed simultaneous to and as a single integrated monolithic unit with the first partition walls 224*a*. The configuration of the partition walls is not limited thereto, but any structure that can arrange the discharge space in to a predetermined pattern of pixel can be applied.

An address electrode 222 is disposed on a lower part of each discharging space 230 defined by the first and second partition walls 224*a* and 224*b*. The common electrode 212*a* and the scan electrode 212*b* of the sustain electrode 212 are disposed on an upper part of the discharging space 230 to form a pair of electrodes having a predetermined discharging gap there between. Then, a discharge can occur between the address electrode 222 and the sustain electrode 212. The bus electrodes 213 connected to each sustain electrode 212 are preferably disposed directly on top of the second partition walls 224*b* to increase an aperture ratio.

A phosphor layer 225 is formed in each discharging space 230 defined by first and the second the partition walls 224*a* and 224*b*. The phosphor layer 225 can be sub-divided into a red phosphor layer, a green phosphor layer, and a blue phosphor layer, and accordingly, the discharging spaces 230 also can be divided into a red color discharging space, a green color discharging space, and a blue color discharging space. The three discharging spaces are disposed close to each other to group the three colors.

The front dielectric layer 214 covers the discharging spaces 230 and is supported by the tops of the first and the second partition walls 224*a* and 224*b* in this second embodiment of the present invention. The front dielectric layer 214 can be formed of the dielectric film 240, and the lattice dielectric layers 241 with a predetermined pattern and the colored dielectric layer 242 are formed on one side of the dielectric film 240. The pattern of the lattice dielectric layers 241 and the colored dielectric layers 242 according to this second embodiment is different from the pattern of the lattice dielectric layers 141 and the colored dielectric layers 142 in the first embodiment.

Each of the lattice dielectric layers 241 is patterned corresponding to the upper surface of the first and the second partition walls 224*a* and 224*b*, and the colored dielectric layers 242 are formed between the lattice dielectric layers 241. In other words, the patterning of the lattice dielectric layer 241 and the colored dielectric layer 242 are coincident with the patterning of the first and second partition walls 224*a* and 224*b* and are formed in a crisscross or matrix pattern as opposed to the striped pattern in the first embodiment of the present invention. The colored dielectric layers 242 are formed in each discharging space 230.

Each of the lattice dielectric layers 241 on the surface of the dielectric film 240 has a predetermined height and width. As mentioned in the previous embodiment, the width of the lattice dielectric layer 241 can vary according to the upper width of the first and the second partition walls 224*a* and 224*b*, but preferably, the width of the lattice dielectric layer 241 is approximately 50~70 μm. The height of the lattice dielectric layer 241 is preferably approximately 20~70 μm when the thickness of the dielectric film 240 is 80 μm. Lattice dielectric layer 241 can be made out of PbO, $B_2O_3$, $SiO_2$, $Al_2O_3$ or ZnO. Further, one of FeO, $RuO_2$, TiO, $Ti_3O_5$, $Ni_2O_3$, $CrO_2$, $MnO_2$, $MnO_3$, $Mo_2O_3$, and $Fe_3O_4$ can, in addition, be mixed in to form the material of the lattice dielectric layer 241.

Each of the colored dielectric layers 242 formed on the dielectric film 240 has a predetermined height. Preferably, this height h2 of the colored dielectric layers 242 are equal to the height h1 of the lattice dielectric layers 241, but this invention is in no way limited thereto. It is preferable that the width of the colored dielectric layers 242 is approximately 130~160 μm.

The colored dielectric layers 242 can be formed of a dielectric material mixed with one of $Fe_2O_3$, $Cu_2O$, CuO, $Ce_2O_3$, $Co_2O_3$, CoO, or $Nd_2O_3$. Preferably, the colored dielectric layers 242 are formed of the same material that can generate optimum colors of red, green, and blue. The colored dielectric layers 242 can also be formed of different materials respectively corresponding to colors of the discharging spaces, to improve the chromaticity of red, green, and blue. For example, a dielectric material for the colored dielectric layer 242 corresponding to the red color green color, and blue color discharging spaces can respectively contain one of $Fe_2O_3$ and $Cu_2O$, one of CuO and $Ce_2O_3$, and one of $Co_2O_3$, CoO, and $Nd_2O_3$.

Separation walls 243 are formed as a part of the front dielectric layer 214 and are formed between the lattice dielectric layers 241 and the adjacent colored dielectric layers 242. Separation walls 243 are preferably made out of the same material as dielectric film 240. The location of the separation walls 243 correspond to the location of the grooves in the compression tool used to make the separation walls 243. However, the separation walls 243 are not limited to the foregoing description, but as description in the previous embodiment, the separation walls 243 can be omitted.

After arranging the lattice dielectric layer 241 and the colored dielectric layer 242 on the dielectric film 240, the front dielectric layer 214 is laminated to the front portion 204. The side of the dielectric film 240 having the lattice dielectric layers 241 and the colored dielectric layers 242 are attached to the side of front substrate 211 having the sustain electrodes 212 and the bus electrodes 213. Efficiency of blocking external light can be increased by disposing the lattice dielectric layers 241 and the colored dielectric layers 242 closer to the front substrate 211 than to the discharging space 230.

The front dielectric layer 214 of the second embodiment is similar to the previous front dielectric layer 114 of the first embodiment, with the exception that according to the present embodiment, the lattice dielectric grooves, lattice dielectric layers, colored dielectric layers and the colored dielectric grooves are formed in a crisscross pattern instead of in a striped pattern. This crisscross or matrix pattern coincides with a crisscross pattern in the partition walls made up of first partition walls orthogonal to second partition walls. The crisscross pattern is also present in the compression tools of the second embodiment and in the pattern masks used to make the plasma display panel of the second embodiment of the present invention.

After forming patterns as above, a lattice dielectric material and a colored dielectric material are respectively filled in the grooves such that the lattice dielectric layers and the colored dielectric layers become one unit with the dielectric film. According to the present invention, by forming lattice dielectric layers and colored dielectric layers on a dielectric film attached to the front portion, chromaticity can be improved, and by reducing the external light reflectance, contrast can be improved. Also, the manufacturing costs can be reduced due to the simplified manufacturing process.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A plasma display panel, comprising:

a front substrate having sustain electrodes arranged with a predetermined distance apart from each other;

a front dielectric layer that covers the sustain electrodes, the front dielectric layer comprising colored dielectric layers comprising a different material for each discharging spaces of red, green, and blue color, and the colored dielectric layers being arranged corresponding to discharging spaces of red, green, and blue colors, respectively, the front dielectric layer further including lattice dielectric layers arranged between the colored dielectric layers, the lattice dielectric layers and the colored dielectric layers being in a same plane;

a rear substrate on which address electrodes are formed in a direction orthogonal to the sustain electrodes, the address electrodes formed on a side of the rear substrate facing the front substrate;

a rear dielectric layer that covers the address electrodes; and partition walls that comprises phosphor layers and define discharging spaces of red, green, and blue colors between the front substrate and the rear substrate, the location of the lattice dielectric layers coinciding with the location of the partition walls.

2. The plasma display panel of claim 1, wherein the front dielectric layer further comprises a dielectric film as a main body, the front dielectric layer being laminated to the front substrate.

3. The plasma display panel of claim 1, wherein the partition walls define boundaries for the discharging space, the partition walls being formed in parallel to each other and spaced apart by a predetermined distance from each other.

4. The plasma display panel of claim 1, wherein the partition walls define the discharging spaces in a matrix form.

5. The plasma display panel of claim 1, the height h2 of the colored dielectric layers being equal to the height h1 of the lattice dielectric layers.

6. The plasma display panel of claim 5, the front dielectric layer further comprising separation walls arranged between the lattice dielectric layers and the colored dielectric layers, the separation walls being distinguished from each of the lattice dielectric layers and the colored dielectric layers.

7. The plasma display panel of claim 5, wherein the lattice dielectric layers and the colored dielectric layers are disposed closer to the front substrate than to the discharging spaces.

8. The plasma display panel of claim 5, the lattice dielectric layers comprising a material selected from the group consisting of FeO, $RuO_2$, TiO, $Ti_3O_5$, $Ni_2O_3$, $CrO_2$, $MnO_2$, $Mn_2O_3$, $Mo_2O_3$, and $Fe_3O_4$.

9. The plasma display panel of claim 5, wherein a width of the lattice dielectric layers is 50~70 μm and a height of the lattice dielectric layers is 20~70 μm.

10. A plasma display panel, comprising:

a front substrate having sustain electrodes arranged with a predetermined distance apart from each other;

a front dielectric layer that covers the sustain electrodes, the front dielectric layer comprising colored dielectric layers comprising a different material for each discharging spaces of red, green, and blue color, and the colored dielectric layers being arranged corresponding to discharging spaces of red, green, and blue colors, respectively;

a rear substrate on which address electrodes are formed in a direction orthogonal to the sustain electrodes, the address electrodes formed on a side of the rear substrate facing the front substrate;

a rear dielectric layer that covers the address electrodes; and partition walls that comprises phosphor layers and define discharging spaces of red, green, and blue colors between the front substrate and the rear substrate, wherein the dielectric material constituting the colored dielectric layer for the red color discharging space comprises a material selected from the group consisting of $Fe_2O_3$, and $Cu_2O$, the dielectric material constituting the colored dielectric layer for the green color discharging space comprises a material selected from the group consisting of CuO, and $Ce_2O_3$, and the dielectric material constituting the colored dielectric layer for the blue color discharging space comprises a material selected from the group consisting of $Co_2O_3$, CoO, and $Nd_2O_3$.

11. A plasma display panel, comprising:

a front substrate having sustain electrodes arranged with a predetermined distance apart from each other;

a front dielectric layer that covers the sustain electrodes, the front dielectric layer comprising colored dielectric layers comprising a different material for each discharging spaces of red, green, and blue color, and the colored dielectric layers being arranged corresponding to discharging spaces of red, green, and blue colors, respectively;

a rear substrate on which address electrodes are formed in a direction orthogonal to the sustain electrodes, the address electrodes formed on a side of the rear substrate facing the front substrate;

a rear dielectric layer that covers the address electrodes; and partition walls that comprises phosphor layers and define discharging spaces of red, green, and blue colors between the front substrate and the rear substrate, wherein a width of the colored dielectric layer is 130~160 μm.

12. A plasma display panel, comprising:

a front portion comprising a front substrate and first electrodes formed on a lower side of the front substrate;

a rear portion comprising a rear substrate and second electrodes formed thereon, said rear portion further comprising partition walls defining discharge cells with phosphor material arranged in each discharge cell; and a front dielectric layer arranged between the front portion and the rear portion, the front dielectric layer comprising patterned lattice dielectric layers adapted to reduce an intensity of external light reflected off the display and patterned colored dielectric layers adapted to improve the chromaticity characteristics of the display, wherein a width of ones of the patterned color dielectric layers are in the range of 130 to 160 microns and a width of ones of the lattice dielectric layers are in the range of 50 to 70 microns.

13. The display of claim 12, the lattice dielectric layers comprising a material selected from the group consisting of FeO, $RuO_2$, TiO, $Ti_3O_5$, $Ni_2O_3$, $CrO_2$, $MnO_2$, $Mn_2O_3$, $Mo_2O_3$, and $Fe_3O_4$.

14. The display of claim 12, the colored dielectric layers comprising a material selected from the group consisting of $Fe_2O_3$, $Cu_2O$, CuO, $Ce_2O_3$, $Co_2O_3$, CoO and $Nd_2O_3$.

15. The display of claim 12, the colored dielectric layers comprising blue colored dielectric layers, green colored dielectric layers and red colored dielectric layers, the green colored dielectric layers comprising at least one of CuO and $Ce_2O_3$.

16. The display of claim 12, wherein the lattice dielectric layers and the colored dielectric layers are arranged on a same plane.

17. The display of claim 12, wherein a height of the colored dielectric layers is equal to a height of the lattice dielectric layers.

18. The display of claim 16, wherein a height of the colored dielectric layers is equal to a height of the lattice dielectric layers.

19. The plasma display panel of claim 12, wherein the lattice dielectric layers and the colored dielectric layers are arranged closer to the front substrate than to the discharging cells.

* * * * *